US007293629B2

(12) United States Patent
Nasuno et al.

(10) Patent No.: US 7,293,629 B2
(45) Date of Patent: Nov. 13, 2007

(54) EXHAUST APPARATUS FOR SMALL-SIZED ENGINE

(75) Inventors: Toshiharu Nasuno, Wako (JP); Takeshi Ishikawa, Wako (JP)

(73) Assignee: Honda Motor Co., Ltd. (JP)

( * ) Notice: Subject to any disclaimer, the term of this patent is extended or adjusted under 35 U.S.C. 154(b) by 291 days.

(21) Appl. No.: 11/031,257

(22) Filed: Jan. 7, 2005

(65) Prior Publication Data

US 2005/0150716 A1 Jul. 14, 2005

(30) Foreign Application Priority Data

Jan. 9, 2004 (JP) ..... 2004-004577

(51) Int. Cl.
*F01N 3/021* (2006.01)
*F01N 3/022* (2006.01)
*F01N 7/18* (2006.01)
*F01N 3/06* (2006.01)

(52) U.S. Cl. ..... 181/231; 181/243; 173/DIG. 2

(58) Field of Classification Search ..... 181/231, 181/252, 256, 258, 241, 243; 173/DIG. 2
See application file for complete search history.

(56) References Cited

U.S. PATENT DOCUMENTS 3,009,531 A * 11/1961 Mead ..... 181/239
3,675,398 A * 7/1972 Giarrizzo ..... 96/132
3,677,364 A * 7/1972 Pawlina ..... 181/269
3,798,769 A * 3/1974 Bailey ..... 30/383
3,949,828 A * 4/1976 Frochaux ..... 181/230
3,987,867 A * 10/1976 Moller ..... 181/231
4,135,602 A * 1/1979 Clark ..... 181/230
4,286,976 A * 9/1981 Eriksson ..... 96/387
4,324,314 A * 4/1982 Beach et al. ..... 181/230
4,424,883 A * 1/1984 Musiani ..... 181/258
4,574,913 A * 3/1986 Fukuda ..... 181/231
4,872,528 A * 10/1989 Goplen et al. ..... 181/228
5,177,962 A * 1/1993 Hall et al. ..... 60/311
5,627,351 A * 5/1997 Okuma et al. ..... 181/231
5,722,237 A * 3/1998 Iida et al. ..... 60/302
5,969,299 A * 10/1999 Yamaguchi et al. ..... 181/227
6,540,046 B1 * 4/2003 Schuhmacher et al. ..... 181/231
6,702,880 B2 * 3/2004 Roberts et al. ..... 96/381
6,968,922 B2 * 11/2005 Kawamata et al. ..... 181/231
2007/0084199 A1 * 4/2007 Whitaker ..... 60/311

FOREIGN PATENT DOCUMENTS

JP 11013452 1/1999

* cited by examiner

*Primary Examiner*—Edgardo San Martin
(74) *Attorney, Agent, or Firm*—Adams & Wilks

(57) ABSTRACT

An exhaust apparatus has an exhaust pipe that receives exhaust gas from an engine and a muffler attached to the exhaust pipe. The muffler has an exhaust portion that discharges exhaust gas received by the exhaust pipe. A tubular member is attached to the exhaust portion and has an exhaust inlet portion for passage therethrough of the exhaust gas discharged through the exhaust portion and an opening portion formed oppositely from the exhaust inlet portion. A filter formed from metal fibers is disposed in the tubular member to reduce an exhaust noise created by the exhaust gas. A cap member is attached to the opening portion of the tubular member and has an exhaust outlet portion that discharges the exhaust gas from the muffler.

13 Claims, 9 Drawing Sheets

EXHAUST APPARATUS FOR SMALL-SIZED ENGINE

FIELD OF THE INVENTION

The present invention relates to an exhaust apparatus for a small-sized engine used as a motive power source for a portable working machine such as a blower and a grass mower.

BACKGROUND OF THE INVENTION

Exhaust apparatuses including exhaust pipes connected to small-sized engines and box-shaped, compact mufflers attached to distal end portions of the exhaust pipes are proposed in, for example, JP-A-11-13452.

FIG. 11 hereof shows an exhaust apparatus disclosed in the above publication. In FIG. 11, the exhaust apparatus, designated by reference numeral 230, includes an exhaust pipe 232 extending from an engine 231, a box-shaped muffler 233 attached to the exhaust pipe 232, and a spark arrester 234 attached to the muffler 233 for preventing sparks contained in exhaust gas of high temperature from being emitted into the air.

The muffler 233 includes a first expansion chamber 235 communicating with the exhaust pipe 232, a second expansion chamber 237 communicating with the first expansion chamber 235 via exhaust passages 241 formed in a partition plate 236, and a tail pipe 238 disposed within the second expansion chamber 237. An exhaust gas flows from the first expansion chamber 235 through the exhaust passages 241 into the second expansion chamber 237. The exhaust gas then flows from the second expansion chamber 237 into the tail pipe 238 through exhaust holes 242 formed in the tail pipe 238.

If the exhaust passages 241 are narrowed or the number of the exhaust holes 242 is reduced for improved exhaust noise reduction, a back pressure increases to thereby heat the muffler 233 to a high temperature. Thus, it is impractical to narrow the exhaust passages 241 or reduce the number of the exhaust holes 242 for improved exhaust noise reduction. If the exhaust passages 241 are widened or the number of the exhaust holes 242 is increased, the back pressure can be reduced to thereby prevent the muffler 233 from being heated too much, but sufficient exhaust noise reduction can not be achieved.

Thus, there has been a demand for an exhaust apparatus for a small-sized engine, which is capable of reducing an exhaust noise with sufficiency while keeping to a minimum a degree to which a muffler is heated.

SUMMARY OF THE INVENTION

According to one aspect of the present invention, there is provided an exhaust apparatus for a small-sized engine, comprising: an exhaust pipe extending outwardly from the engine; a muffler attached to the exhaust pipe and having an exhaust portion for discharging an exhaust gas; the muffler including: a tubular member attached to the exhaust portion and having an exhaust inlet portion for passage of the exhaust gas therethrough and an opening portion formed oppositely from the exhaust inlet portion; a filter formed from metal fibers and disposed in the tubular member for reducing an exhaust noise; and a cap member attached to the opening portion of the tubular member and having an exhaust outlet portion.

With this arrangement, exhaust energy can be reduced by impingement of the exhaust gas on the metal fibers of the filter disposed in the tubular member, with the result that the exhaust noise can be reduced. Namely, there is no need to narrow any passageway or hole for passage of the exhaust gas for the purpose of reduction in the exhaust noise. Thus, a degree to which the muffler is heated can be kept to a minimum. By virtue of the filter formed of metal fibers, it becomes possible to efficiently reduce the exhaust noise.

In a preferred form of the present invention, the muffler further includes a wire net covering at least the exhaust inlet portion of the tubular member for preventing sparks contained in the exhaust gas from being emitted from the muffler.

With the simple arrangement, more specifically, by virtue of the wire net covering at least the exhaust inlet portion of the tubular member, the exhaust apparatus is imparted with the function of a spark arrester for preventing sparks contained in the exhaust gas from being emitted from the muffler.

Desirably, the filter is made of stainless steel fibers.

Since the stainless steel imparts both increased thermal resistance and increased corrosion resistance, the filter made from such stainless steel fibers can hardly be corroded by sulfide contained in the exhaust gas.

BRIEF DESCRIPTION OF THE DRAWINGS

A preferred embodiment of the present invention will be described in detail below, by way of example only, with reference to the accompanying drawings, in which.

DETAILED DESCRIPTION OF THE PREFERRED EMBODIMENTS

Figure 1:
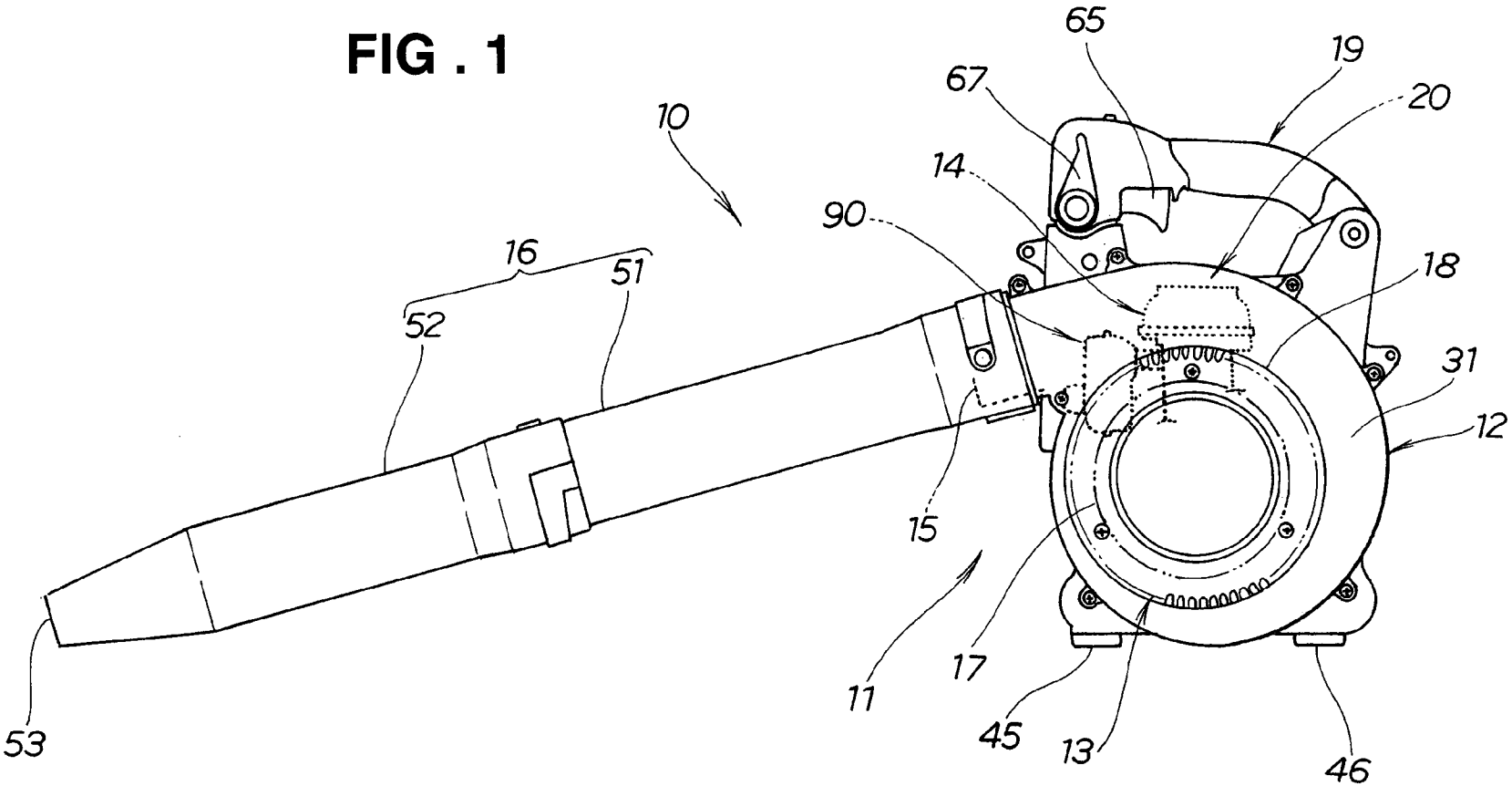
FIG. 1 is a side elevation view of a portable working machine employing an exhaust apparatus for a small-sized engine according to the present invention.
Figure 2:
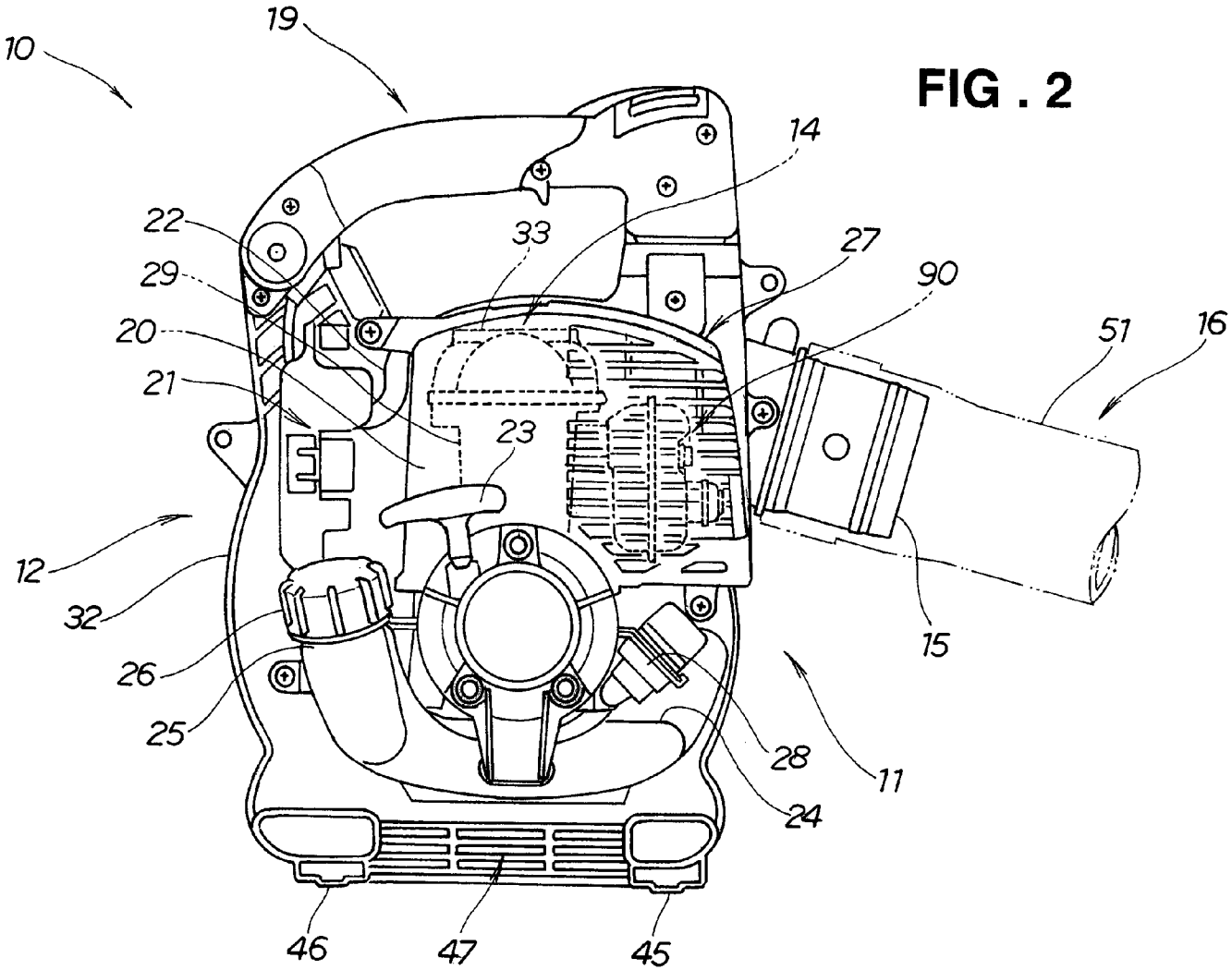
FIG. 2 is a side elevation view of the portable working machine with the exhaust apparatus covered with a prime mover cover.

As shown in FIG. 1 and FIG. 2, a portable fan unit 10 employs an exhaust apparatus 90 for a small-sized engine (hereinafter referred to as "engine") 14 according to one embodiment of the present invention.

Referring to FIG. 1, the portable fan unit 10 includes a fan housing 12 housing a fan 13 therein, and a prime mover unit 20 attached to the fan housing 12 for driving the fan 13. A discharge duct 16 is attached to a discharge portion 15 formed in the fan housing 12 for discharging an air from the fan housing 12. A fan cover 18 is attached to an intake portion of the fan housing 12. The fan housing 12 has an upper part to which a main handle 19 is attached.

The portable fan unit 10 has a body 11 constituted by the fan housing 12, the fan cover 18 and the main handle 19.

As shown in FIG. 2, the prime mover unit 20 is attached to a right fan housing 32 as will be explained later. A prime mover cover 27 covers the engine 14 and the exhaust apparatus 90 of the prime mover unit 20.

Figure 3:
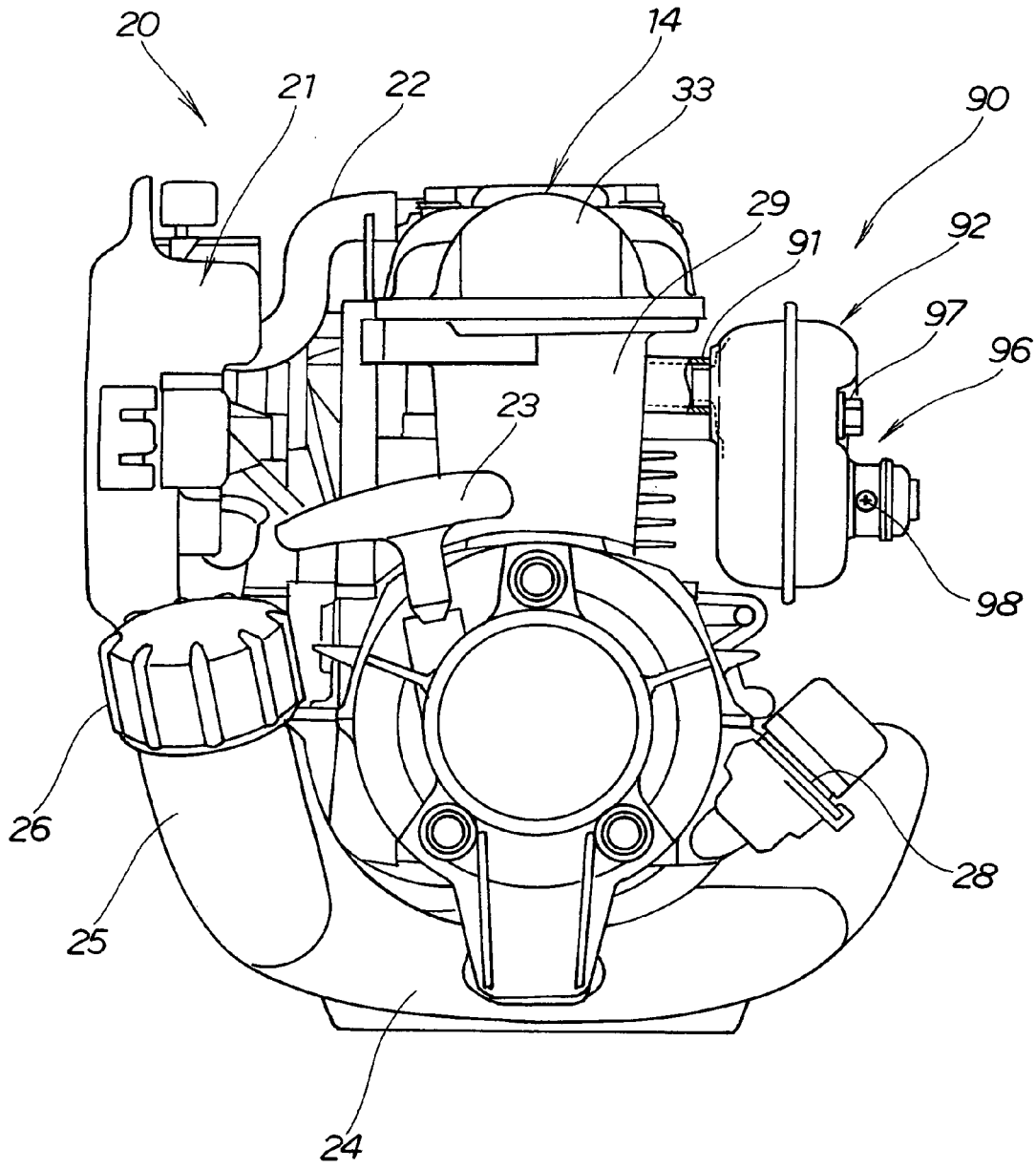
FIG. 3 is a side elevation view of a prime mover unit shown in FIG. 2.

FIG. 3 shows the prime mover unit 20 as shown in FIG. 2.

The prime mover unit 20 includes the engine 14 for driving the fan 13 (FIG. 1), an air cleaner 21 for purifying air to be supplied to the engine 14, a hose 22 through which the purified air is directed from the air cleaner 21 to the engine 14, a knob 23 of a recoil starter for starting the engine 14, a fuel tank 24 for storing a fuel to be supplied to the engine 14, and a cap 26 for closing a fueling port 25 of the fuel tank 24. The prime mover cover 27 (FIG. 2) covers the engine 14 and the exhaust apparatus 90. The prime mover unit 20 has an engine oil pouring port 28 formed therein for pouring of an engine oil through the engine oil pouring port 28 into the engine 14. Reference numeral 29 denotes a cylinder block of the engine 14. Reference numeral 33 denotes a cylinder head of the engine 14.

Figure 4:
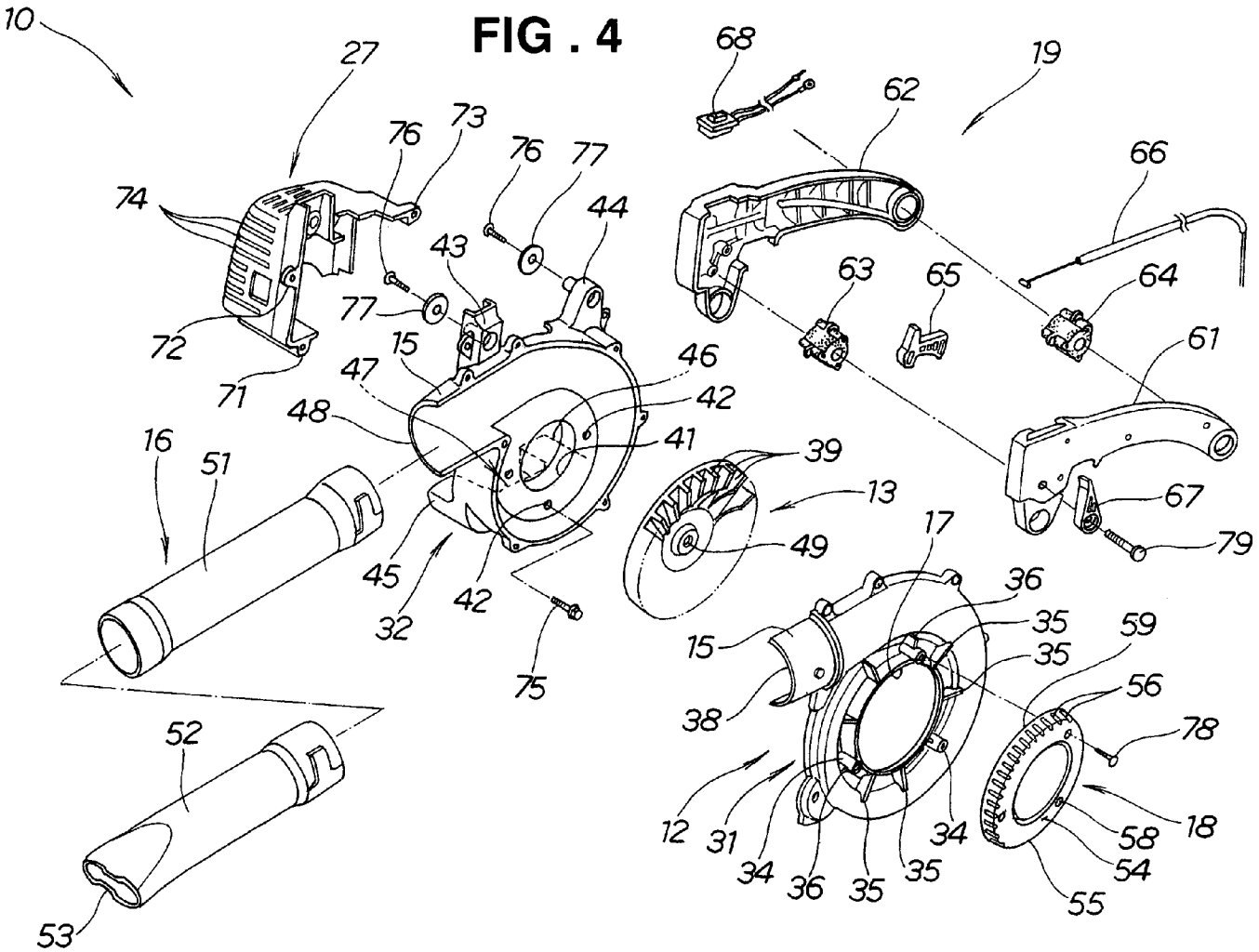
FIG. 4 is an exploded perspective view of the portable working machine shown in FIG. 1 with the engine and the exhaust apparatus omitted.

Referring to FIG. 4, the fan housing 12 includes a left fan housing 31 to which the fan cover 18 is attached, and the right fan housing 32 to which the prime mover unit (FIG. 3) is attached.

The intake portion of the left fan housing 31 has an intake port 17 formed therein for taking in an air from outside the fan housing 12 into the fan housing 12. The fan cover 18 is attached by attachment screws 78 to plural boss portions 34 provided in the left fan housing 31. The left fan housing 31 has a plurality of reinforcing ribs 35, 36 and a left side 38 of the discharge portion 15.

Each of the reinforcing ribs 35 extends radially outwardly from the intake portion 17 of the left fan housing 31 beyond an outer periphery of the fan cover 18. The three ones of the reinforcing ribs 36 are formed on the respective boss portions 34 of the left fan housing 31 and arranged angularly in correspondence to the outer periphery of the fan cover 18.

The right fan housing 32 has an insertion aperture 41 through which an output part (not shown) of the engine 14 (FIG. 3) is inserted for attachment to a shaft portion 49 of the fan 13. The right fan housing 32 has a plurality of through holes 42 through which plural attachment screws 75 pass for attachment of the prime mover unit 20 to the right fan housing 32. The right fan housing 32 has front and rear support portions 43, 44 supporting the main handle 19, stands 45, 46 for keeping the body 11 in an erected position, an auxiliary handle 47 disposed between the stands 45, 46 and formed integrally therewith, and a right side 48 of the discharge portion 15.

The fan 13 includes the shaft portion 49 attached to the output part of the engine 14 and a plurality of blades 39 extending radially outward from the shaft portion 49.

The left side 38 of the discharge portion 15 and the right side 48 of the discharge portion 15 jointly form the discharge portion 15.

The discharge duct 16 includes a rear duct member 51 to be attached to the discharge portion 15, and a front duct member 52 to be attached to a front end portion of the rear duct member 51. The front duct member 52 has a blast port 53 formed in a tapered distal end portion thereof.

The fan cover 18 has a tray-shaped configuration. The fan cover 18 includes a body portion (a bottom portion) 54 and a side portion 55 extending obliquely outwardly from the body portion 54. The side portion 55 has a plurality of slits 56 formed in an outer periphery thereof and arranged at equal angular intervals. The bottom portion 54 has through holes 58 through which screws 78 pass for attachment of the fan cover 18 to the left fan housing 31.

Reference numeral 59 denotes an outer peripheral edge of the fan cover 18. Because the slits 56 are formed only in the side portion 55, clothe of an operator are prevented from being clung to the fan cover 18 when the fan 13 is in operation such as a cleaning operation.

The main handle 19 includes a left half handle member 61, a right half handle member 62 to be coupled to the left half handle member 61, anti-vibration rubbers 63, 64 to be interposed between the left half handle member 61 and the right half handle member 62, a throttle lever 65 swingably attached to the left half handle member 61 and the right half handle member 62, a throttle wire 66 to be connected to the throttle lever 65, a throttle retention lever 67 to be attached to the left half handle member 61 and the right half handle member 62 for holding the throttle lever 65 in any desired position, and a starting switch 68 to be attached to the left half handle member 61 and the right half handle member 62 for making the engine 14 ready to start, or stopping the engine 14.

The prime mover cover 27 has a plurality of flange portions 71, 72, 73 to be attached to the right fan housing 32. The prime mover cover 27 has plural vent-holes 74 formed therein.

The prime mover unit (FIG. 3) is attached to the right fan housing 32 by the attachment screws 75 passing through the through holes 42 and screwed into the prime mover unit. The main handle 19 is attached via washers 77, 77 to the front and rear support portions 43, 44 by attachment screws 76, 76 passing through the main handle 19 and the washers 77, 77 and screwed into the support portions 43, 44 formed on a top surface of the right fan housing 32. The fan cover 18 is attached to the left fan housing 31 by the attachment screws 78 passing through the through holes 58 and screwed into the boss portions 34. The throttle retention lever 67 is attached to the left half handle member 61 and the right half handle member 62 by attachment screws 79.

Figure 5:
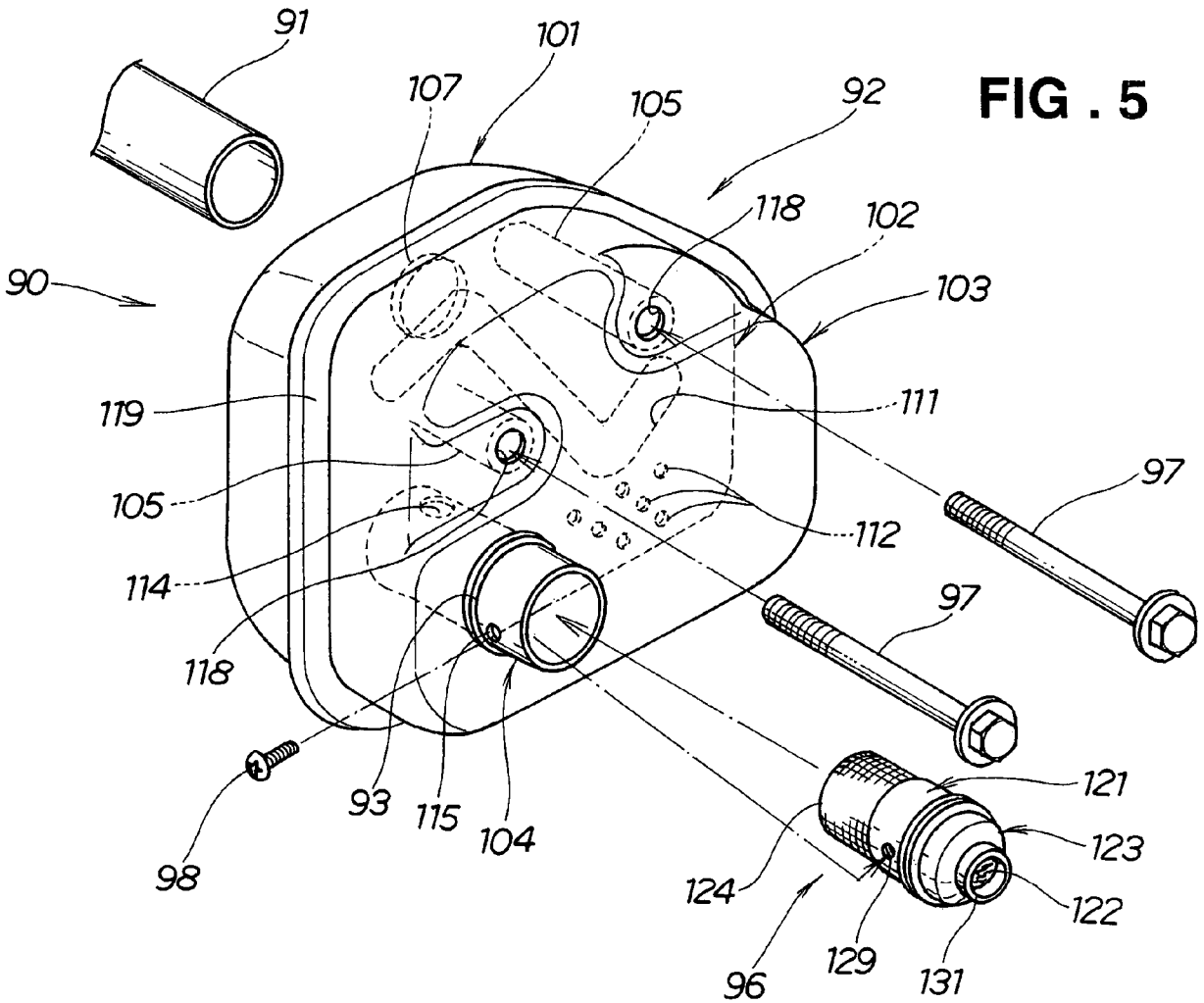
FIG. 5 is an exploded perspective view of the exhaust apparatus.

FIG. 5 shows in perspective the exhaust apparatus 90 for the engine 14 according to one embodiment of the present invention.

The exhaust apparatus 90 includes an exhaust pipe 91 extending from the engine 14 (FIG. 3), and a silencer (muffler) 92 connected to a distal end portion of the exhaust pipe 91. The muffler 92 includes a muffler piece 96 having a filter 122 incorporated therein for further reducing an exhaust noise, and an exhaust portion including a tubular tail pipe 104 to which the muffler piece 96 is detachably attached by an attachment screw 98. The filter 122 is formed of metal fibers. The muffler 92 is attached to the engine 14 (FIG. 3) by bolts 97, 97.

The muffler 92 further includes an inlet side case 101 facing to the exhaust pipe 91, a partition plate 102 (see FIG. 7), an outlet side case 103 disposed opposite the inlet side case 101 with the partition plate 102 interposed therebetween, and pipes 105, 105 extending from the inlet side case 101 through the partition plate 102 to the outlet side case 103 for insertion of the 10 bolts 97, 97 through the pipes 105, 105. The tail pipe 104 (see FIG. 7) extends to the partition plate 102 through a through hole 93 formed in the outlet side case 103. The inlet side case 101, outlet side case 103, and partition plate 102 form a casing of the muffler 92.

Figure 6:
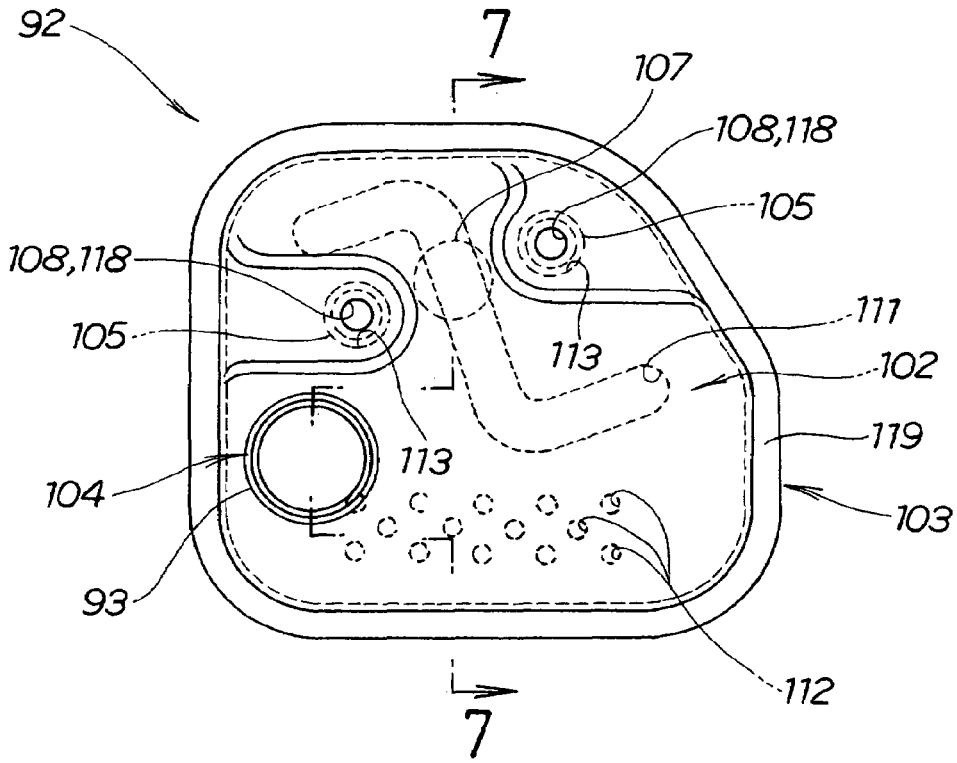
FIG. 6 is a front elevation view of a muffler of the exhaust apparatus shown in FIG. 5.
Figure 7:
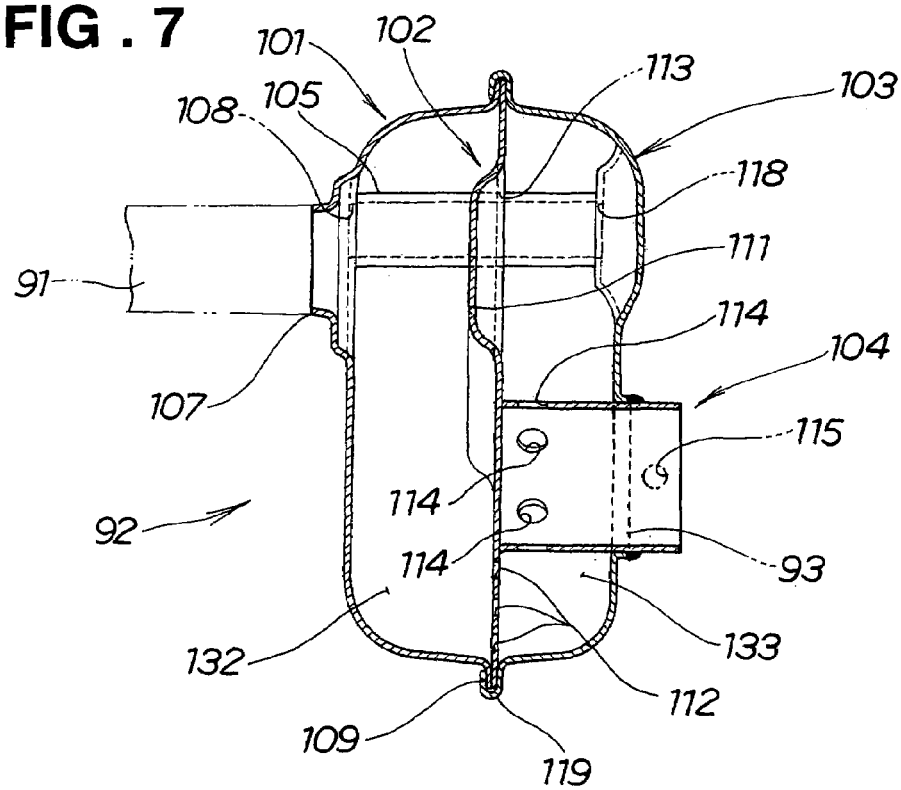
FIG. 7 is a cross-sectional view taken along line 7-7 of FIG. 6.

As shown in FIG. 6 and FIG. 7, the inlet side case 101 has a connection opening portion 107 connected to the exhaust pipe 91, and holes 108, 108 through which the bolts 97, 97 (FIG. 5) extending through the pipes 105, 105 pass. The inlet side case 101 has a flange portion 109 joined to the partition plate 102 and a curled portion 119 of the outlet side case 103.

The partition plate 102 has a bead 111 for reinforcing the partition plate 102 itself, a plurality of exhaust holes 112 through which an exhaust gas passes, and through holes 113, 113 through which the pipes 105, 105 extend.

The outlet side case 103 has the through hole 93 through which the tail pipe 104 extends, and holes 118, 118 through which the bolts 97, 97 (FIG. 5) inserted into the pipes 105. 105. The curled portion 119 of the outlet side case 103 is formed by a curling and joins the flange portion 109 of the inlet side case 101 and the partition plate 102 together.

The tail pipe 104 is welded to a portion of the outlet side case 103 where the through hole 93 is formed. The tail pipe 104 has a plurality of through holes 114 through which an exhaust gas passes, and an attachment hole 115 through which the attachment screw 98 passes for attaching the muffler piece 96 to the tail pipe 104.

A first expansion chamber 132 is defined by the inlet side case 101 and the partition plate 102. A second expansion chamber 133 is defined by the partition plate 102 and the outlet side case 103.

Figure 8:
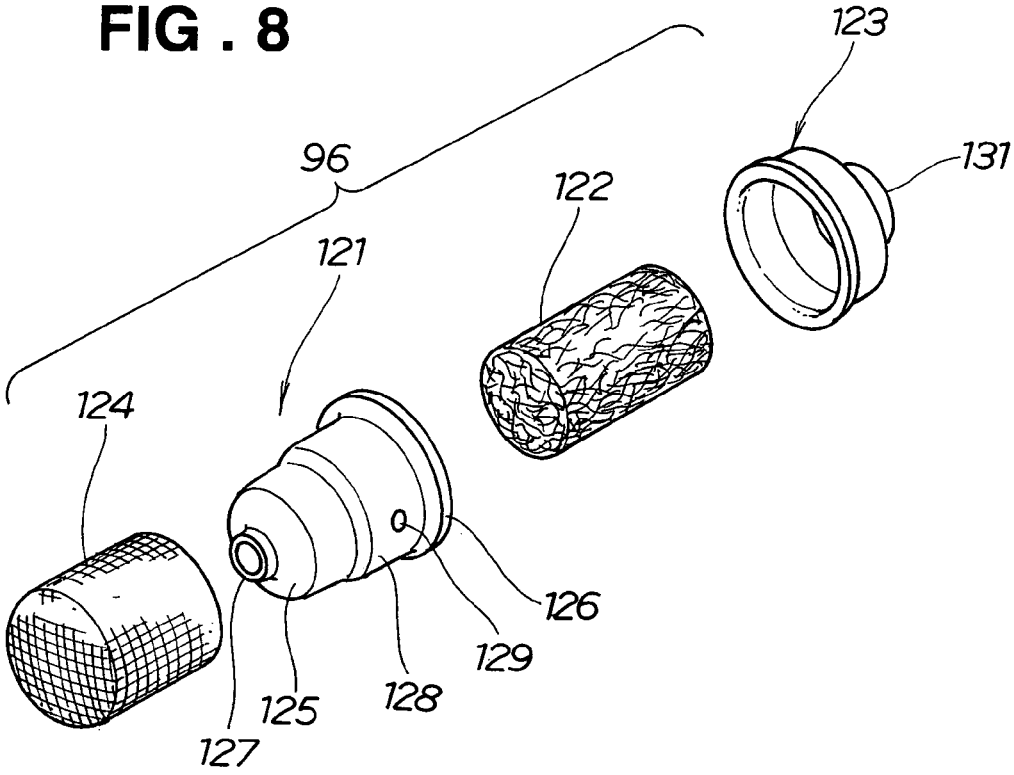
FIG. 8 is an exploded perspective view of a muffler piece of the muffler shown in FIG. 7.
Figure 9:
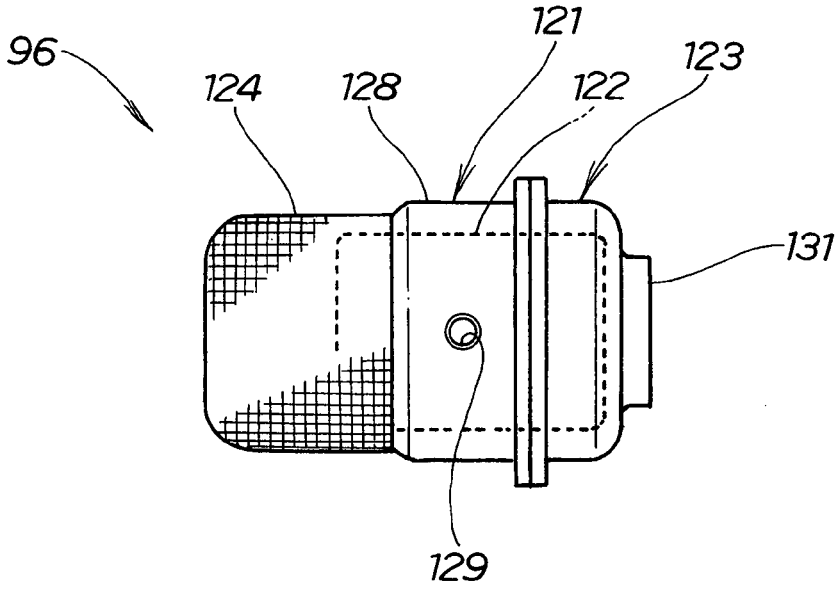
FIG. 9 is a side elevation view of the muffler piece.

As shown in FIG. 8 and FIG. 9, the muffler piece 96 includes a cup-shaped or tubular member 121 to be attached to the tail pipe 104 (FIG. 7), the filter 122 of metal fibers disposed in the tubular member 121 for reducing an exhaust noise, a cap member 123 attached to an opening portion 126 of the tubular member 121, and a wire net 124 attached to a bottom part 125 of the tubular member 121 for preventing sparks contained in an exhaust gas of high temperature from being emitted out of the muffler piece 96.

The bottom part 125 is disposed opposite the opening portion 126 and has an exhaust inlet portion 127 formed for passage of the exhaust gas therethrough and covered by the wire net 124 which has a tubular structure. The tubular member 121 has a tubular portion 128 having the screw hole 129 formed therein. The attachment screw 98 (FIG. 5) is screwed through the attachment hole 115 of the tail pipe 104 into the screw hole 129 to attach the muffler piece 96 to the tail pipe 104 (FIG. 7). The cap member 123 has an exhaust outlet portion 131 from which the exhaust gas is discharged out.

The filter 122 is made of a sound absorbing material. For example, the filter 122 may be formed from various metal fibers. The filter 122 is preferably formed from fibers of stainless steal having an increased thermal resistance and an increased corrosion resistance. The filter 122 formed from the stainless steel fibers is unlikely to be easily corroded by sulfide contained in the exhaust gas.

The muffler piece 96 is a replaceable cartridge (a replaceable unit) composed of the tubular member 121, the filter 122 formed of metal fibers, the cap member 123 and the wire net 124. More specifically, with the filter 122 disposed in the tubular member 121 and the cap member 123 and the wire net 124 attached to the tubular member 121, the tubular member 121 is detachably attached to the tail pipe 104 (FIG. 7) extending through the through hole 93. The tubular member 121 can be readily replaced with new one when the filter 122 becomes dirty. It thus becomes possible to efficiently perform a maintenance operation on the exhaust apparatus 90 (FIG. 5).

The metal fibers of the filter 122 may have an amount set to be suitable for various applications. The muffler piece 96 may be designed to provide an adjusted back pressure.

Figure 10:
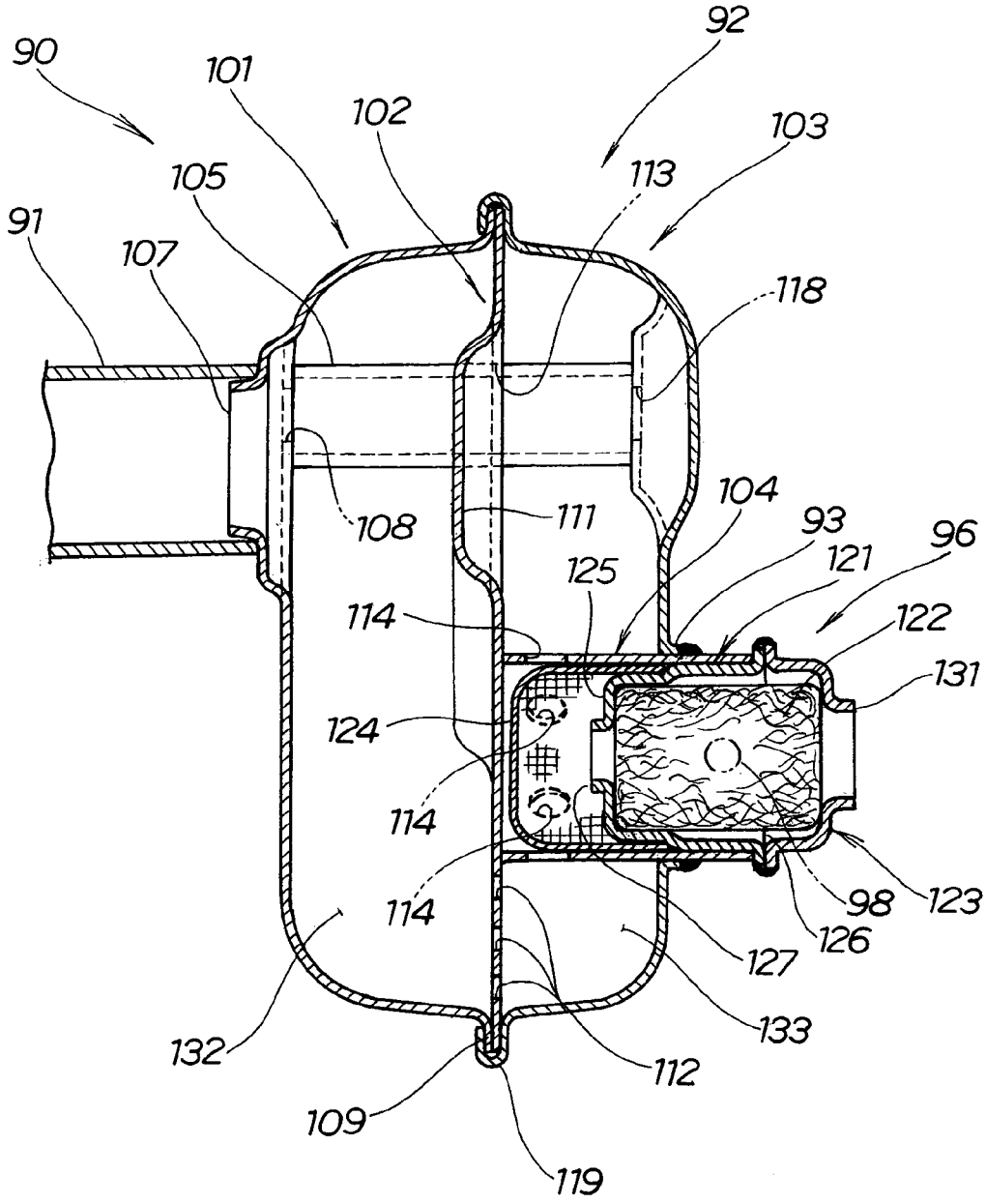
FIG. 10 is a cross-sectional view of the exhaust apparatus.
Figure 11:
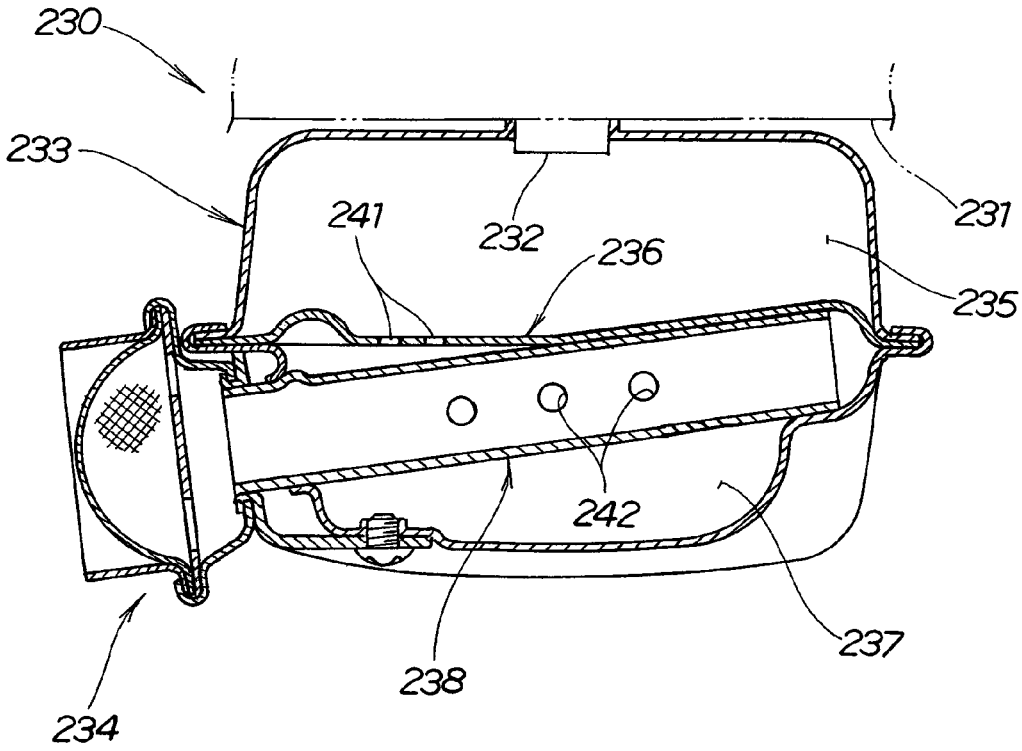
FIG.11 (PRIOR ART)
FIG. 11 is a cross-sectional view of a conventional exhaust apparatus.

As shown in FIG. 10, the muffler 92 of the exhaust apparatus 90 according to one embodiment of the present invention includes the tubular member 121 attached to the tail pipe 104 extending through the through hole 93 and having the exhaust inlet portion 127 formed in the bottom part 125 for passage of the exhaust gas through the exhaust inlet portion 127, the filter 122 of the metal fibers disposed or included in the tubular member 121 for reducing the exhaust noise, and the cap member 123 attached to the opening portion 126 of the tubular member 121 and having the exhaust outlet portion 131.

By virtue of the filter 122 disposed in the tubular member 121, the exhaust noise can be reduced. That is, the exhaust noise is reduced as the exhaust gas passes through the filter 122. In other words, the reduction in the exhaust noise can be accomplished without having to narrow any passage or hole through which the exhaust gas passes. Because any passage or hole for the exhaust gas is not narrowed, a back pressure does not increase. Therefore, an amount of heat within the muffler 92 is kept to a minimum while the reduction in the exhaust noise can be achieved by the complicated metal fibers of the filter 122.

The muffler piece 96 has a function as a spark arrester for preventing sparks contained in the exhaust gas from being emitted out of the muffler piece 96. This function as the spark arrester can be served by a simple arrangement, more specifically, by attachment of the wire net 124 to the bottom part 125 of the tubular member 121.

Since the wire net 124 is located on a side of the exhaust inlet portion 127 of the tubular member 121, the sparks can be absorbed within the muffler 92 without being emitted out of the muffler 92. The thus arranged muffler piece 96 can more effectively function as the spark arrester.

Although, in the illustrated embodiment, the muffler piece 96 is attached to the tail pipe 104, the muffler piece 96 may be attached directly to the portion of the outlet side case 103 defining the through hole 93 without the use of the tail pipe 104.

As discussed above, the exhaust apparatus for the small-sized engine according to the present invention can function as a muffler while keeping to a minimum a degree to which the muffler is heated. The exhaust apparatus thus arranged is suitable for use in a small-sized engine of a portable working machine such as a blower or grass mower.

Obviously, various minor changes and modifications of the present invention are possible in the light of the above teaching. It is therefore to be understood that within the scope of the appended claims the invention may be practices otherwise than as specifically described.

What is claimed is:

1. An exhaust apparatus for a small-sized engine, comprising:

an exhaust pipe that receives exhaust gas from an engine; and a muffler attached to the exhaust pipe and comprising an exhaust portion that discharges exhaust gas received by the exhaust pipe, a tubular member attached to the exhaust portion and having an exhaust inlet portion for passage therethrough of the exhaust gas discharged through the exhaust portion and an opening portion formed oppositely from the exhaust inlet portion, a filter formed from metal fibers and disposed in the tubular member to reduce an exhaust noise created by the exhaust gas, and a cap member attached to the opening portion of the tubular member and having an exhaust outlet portion to discharge the exhaust gas from the muffler.

2. An exhaust apparatus according to claim 1; wherein the muffler further comprises a wire net covering at least the exhaust inlet portion of the tubular member to prevent sparks contained in the exhaust gas from being emitted from the muffler.

3. An exhaust apparatus according to claim 1; wherein the filter is made of stainless steel fibers.

4. An exhaust apparatus according to claim 1; wherein the muffler further comprises a case; and wherein the exhaust portion comprises a tail pipe connected to the case and receiving the tubular member.

5. An exhaust apparatus according to claim 4; wherein the case comprises an inlet side case having a connection opening portion connected to the tail pipe, and an outlet side case disposed opposite the inlet side case and having the exhaust portion.

6. An exhaust apparatus according to claim 1; wherein the muffler further comprises an inlet side case having a connection opening portion connected to the exhaust pipe, an outlet side case disposed opposite the inlet side case and having the exhaust portion, and a partition plate interposed between the inlet side case and the outlet side case.

7. An exhaust apparatus according to claim 6; wherein the muffler further comprises a first expansion chamber defined by the inlet side case and the partition plate, and a second expansion chamber defined by the partition plate and the outlet side case.

8. An exhaust apparatus according to claim 6; wherein the exhaust portion comprises a tubular pipe integrally connected to the outlet side case and extending outwardly from the second expansion chamber.

9. An exhaust apparatus according to claim 8; wherein the tubular member, filter and cap member are assembled together as an integral unit structure extending into and removably connected to the tubular pipe.

10. An exhaust apparatus according to claim 9; wherein the integral unit structure further comprises a wire net covering at least the exhaust inlet portion of the tubular member for preventing sparks contained in the exhaust gas from being emitted from the muffler.

11. An exhaust apparatus according to claim 10; wherein the wire net has a tubular structure and covers a portion of the tubular member having the exhaust inlet portion.

12. A muffler for reducing exhaust noise generated by exhaust gas emitted by an exhaust pipe connected to an engine, the muffler comprising:

an inlet side case having a connection opening portion for connection to the exhaust pipe and through which exhaust gas emitted by the exhaust pipe enters into the inlet side case;

an outlet side case connected to the inlet side case and having an exhaust portion for discharging exhaust gas that has entered the inlet side case;

a partition plate interposed between the inlet side case and the outlet side case and having a plurality of exhaust holes through which exhaust gas passes from the inlet side case into the outlet side case; and a muffler piece for reducing exhaust noise generated by the exhaust gas, the muffler piece being configured for removable connection to and disconnection from the exhaust portion of the outlet side case without disconnecting the inlet side case and the outlet side case from one another.

13. An exhaust apparatus comprising an exhaust pipe; and a muffler for reducing exhaust noise generated by exhaust gas generated by an engine and transmitted therefrom through the exhaust pipe, the muffler comprising: a casing having an opening portion connected to the exhaust pipe and defining a first expansion chamber for receiving through the opening portion exhaust gas transmitted by the exhaust pipe and a second expansion chamber for receiving the exhaust gas from the first expansion chamber, the second expansion chamber having an exhaust portion for discharging the exhaust gas; a tubular member removably connected to the exhaust portion of the second expansion chamber and having an exhaust inlet portion for passage therethrough of the exhaust gas discharged through the exhaust portion and an opening portion; a filter disposed in the tubular member and made of a sound absorbing material; and a cap member attached to the opening portion of the tubular member and having an exhaust outlet portion for discharging the exhaust gas from the muffler.

* * * * *